US005414997A

United States Patent [19]

Tailer

[11] Patent Number: 5,414,997

[45] Date of Patent: May 16, 1995

[54] THERMAL LAG MACHINE

[76] Inventor: Peter L. Tailer, Box 1327, Edgartown, Mass. 02539

[21] Appl. No.: 2,717

[22] Filed: Jan. 11, 1993

[51] Int. Cl.[6] ..... F01B 29/08

[52] U.S. Cl. ..... 60/516; 60/682

[58] Field of Search ..... 60/516, 650, 682

[56] References Cited

U.S. PATENT DOCUMENTS 2,836,033 5/1958 Marrison ..... 60/516

4,489,553 12/1984 Wheatley et al. ..... 60/516

*Primary Examiner*—Stephen F. Husar

[57] ABSTRACT

A thermal lag engine has a cooled cylinder and piston connected to a heated chamber. A working fluid in the cooled cylinder and heated chamber is alternately compressed and expanded by the piston. Since there is a thermal lag or time interval before the working fluid entering the hot chamber is heated and the working fluid expanding back into the cooled cylinder is cooled, the working fluid is at a lower average temperature and pressure during compression and a higher average temperature and pressure during expansion to provide net work.

17 Claims, 2 Drawing Sheets

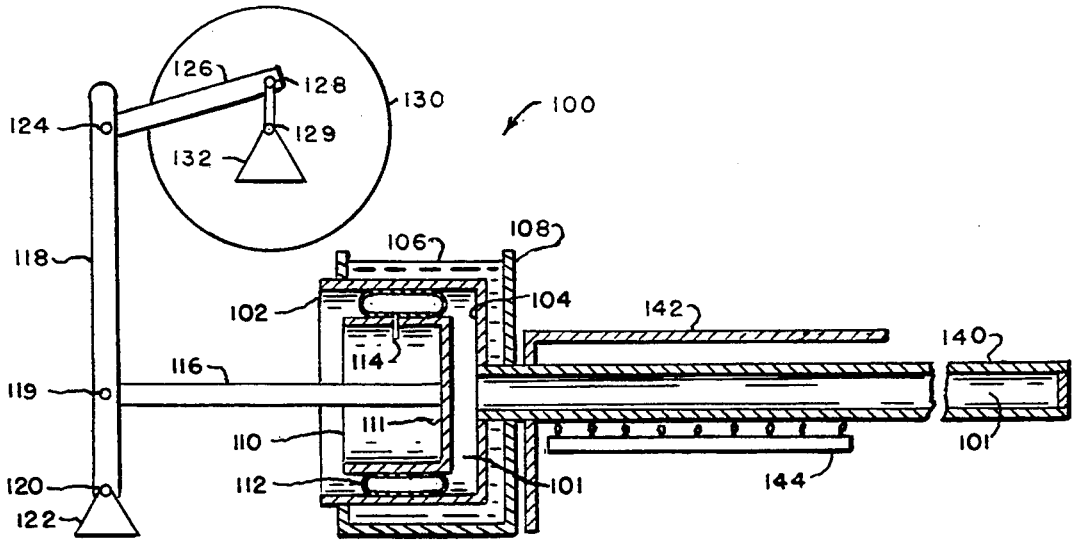
FIG. 1
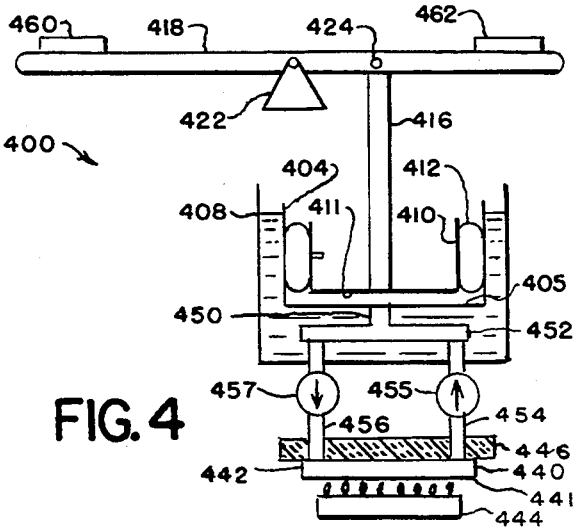
FIG. 4
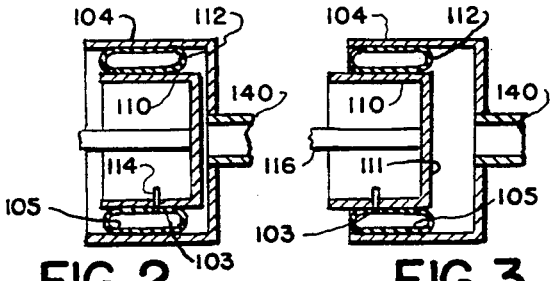
FIG. 2
FIG. 3
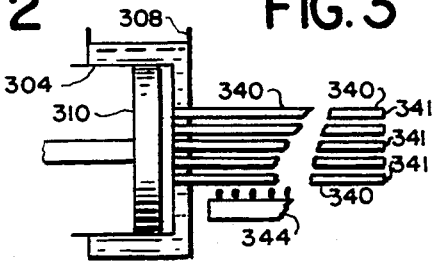
FIG. 7
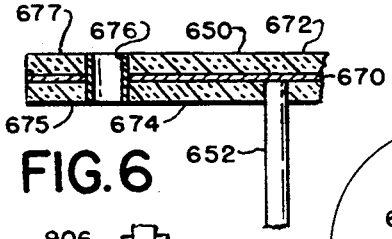
FIG. 6
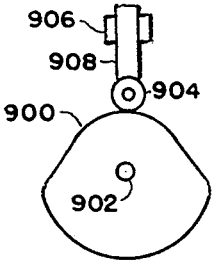
FIG. 13
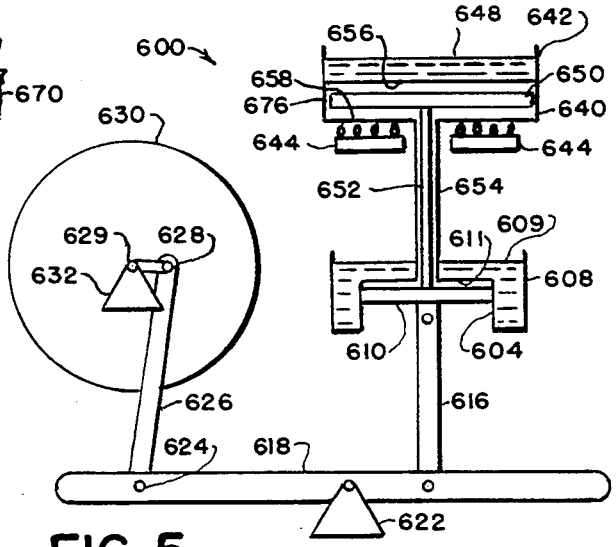
FIG. 5

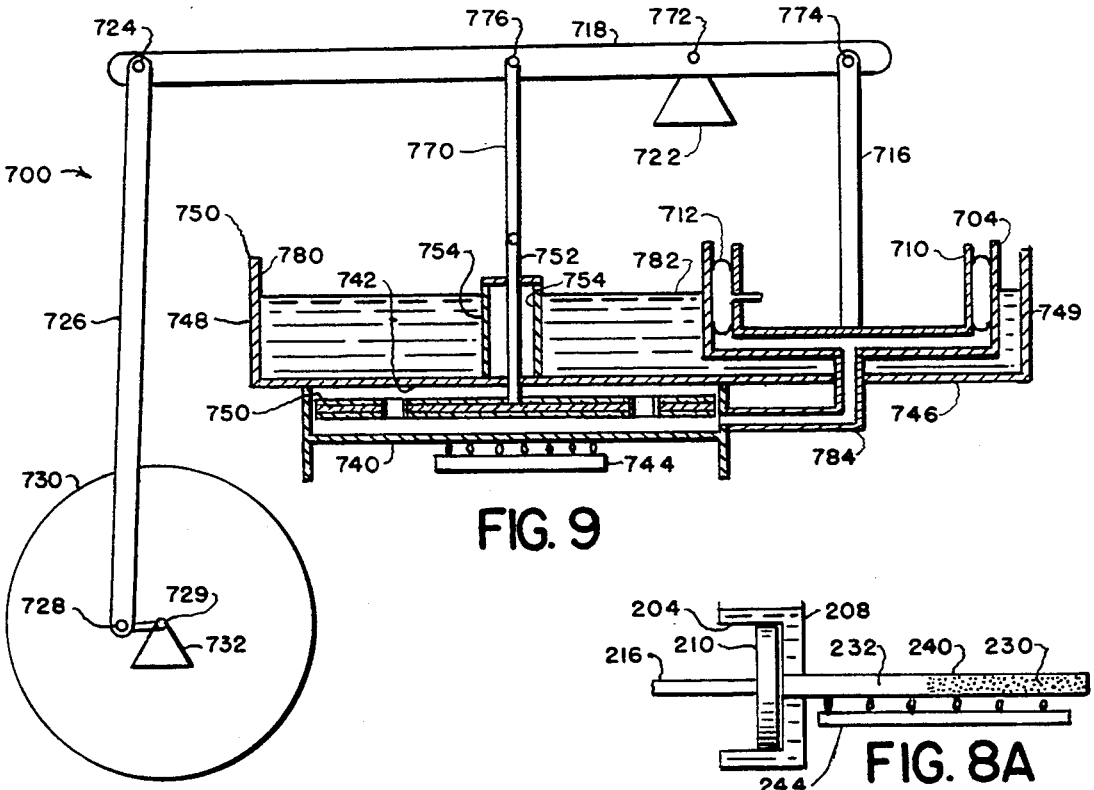
FIG. 9
FIG. 8A
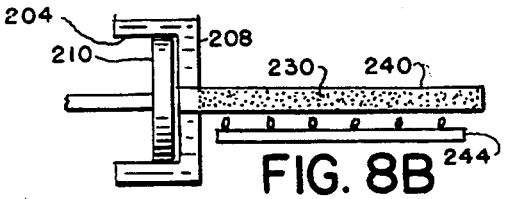
FIG. 8B
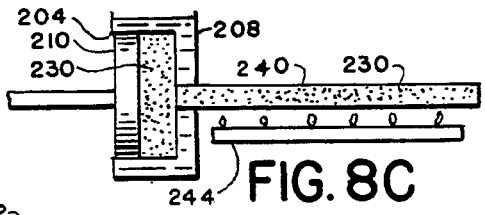
FIG. 8C
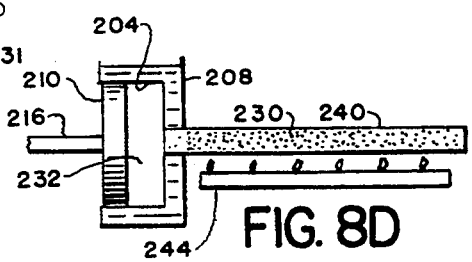
FIG. 8D
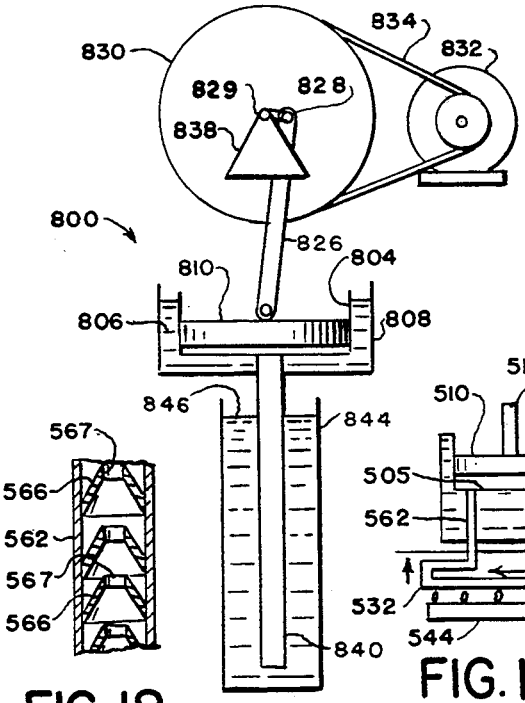
FIG. 10
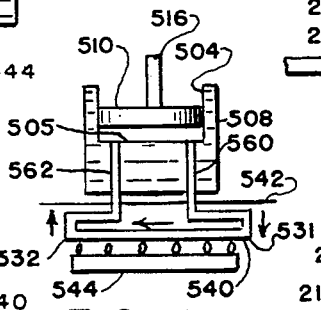
FIG. 11
FIG. 12

THERMAL LAG MACHINE

BACKGROUND

This invention relates to external combustion heat engines, heat pumps, and refrigeration devices.

Experimenting with Stirling engines using air at mean atmospheric pressure as a working fluid, it was found that a main factor limiting power for a given size of engine was the time required for heat to transfer to the working fluid. For this reason an experimental engine that was not a Stirling engine was built to take advantage of and actually use this time required for heat transfer which is referred to as thermal lag. An ultimately simple engine using only a cooled cylinder and piston connected to a heated chamber ran both as a free piston engine and as a kinematic engine.

SUMMARY

A main object of this invention is to provide an external combustion heat engine of the ultimate simplicity. This engine has the potential for very high efficiency and high power for weight and volume when built with high technology materials using working fluids at high pressures. Because this engine uses the thermal lag in heat transfer, there is no need for the complex phase shifting linkages of Stirling engines or the need for the cam activated valves of steam engines, Ericsson cycle engines, etc.

The simplest form of the heat engine of this invention has a cooled cylinder containing a piston, a heated chamber communicating with the cooled cylinder, and a working fluid in the engine volume undergoing compression and expansion by the movement of the piston in the cylinder. During an engine cycle, cooled working fluid flows into the heated chamber during compression, the cooled working fluid in the heated chamber heats during a time interval at the end of compression, heated working fluid flows from the heated chamber into the cooled cylinder during expansion, and the heated working fluid in the cooled cylinder cools during a time interval at the end of expansion. Since the working fluid pressure is lower during compression and higher during expansion, net work is produced by the piston. Substantially sinusoidal motion of the piston, either free piston or connected to a crank, provides an effective time delay at the ends of the piston stroke.

The concept of this ultimately simple heat engine was reduced to practice with an engine using air at mean atmospheric pressure as the working fluid. Unlike other heat engines, the thermal lag engine need have no mechanical elements, such as pistons, displacers, or valves, associated with its heated chamber. Only working fluid flows in and out of the heated chamber. Thus, as an external combustion engine, it can operate with high temperatures in the heated chamber limited limited only by available temperature resistant materials which need not be formed to close tolerances to accommodate pistons or the like. This allows engines of high efficiency to be built to use any fuel or heat source.

In another embodiment of the invention, added cooling area may be provided by an additional cooled volume connected between the cylinder and the heated chamber. With two passages containing check valves between spaced apart portions of the cylinder and ends of the heated chamber, one check valve allowing flow into the heated chamber and the other allowing flow out, a circulatory flow is provided through the heated chamber and, to some extent, through the cylinder. Circulatory flow ensures that the last portion of the working fluid entering the heated chamber is the last to leave it so that all portions of the working fluid spend the same amount of time in the heated chamber. If there is an additional cooled volume entered by the two passages, the check valves can also provide a circulatory flow through it.

In another embodiment of the invention, the heated chamber has a heated and a cooled wall and contains a non-regenerative displacer moving between the heated and cooled walls. The non-regenerative displacer, unlike the displacer of a Stirling engine, may be directly connected to or linked to move with the piston. This avoids the complex linkages required by Stirling engines.

A thermal lag machine may be used as a heat pump or refrigeration device by driving the piston. Many other features and advantages of this invention will be better understood from the following description and accompanying drawings.

BRIEF DESCRIPTION OF THE DRAWINGS

FIG. 1 is a longitudinal section through a first embodiment of this invention;

FIGS. 2 and 3 are longitudinal sections through a piston and cylinder shown, respectively, at top dead center and bottom dead center;

FIG. 4 is a schematic drawing through a second embodiment of this invention having an additional cooling volume between a heated chamber and a cylinder;

FIG. 5 is a schematic drawing of a third embodiment of this invention having a non-regenerative displacer connected to a piston;

FIG. 6 is a section through a broken away fragment of a non-regenerative displacer;

FIG. 7 is a longitudinal section showing a heated chamber formed as a multiplicity of heated tubes connected to a cylinder;

FIGS. 8A, 8B, 8C, and 8D are longitudinal sections through a cooled cylinder and a heated chamber showing the cylinder and chamber, respectively, immediately after compression, after a time interval following compression, immediately after expansion, and after a time interval following expansion;

FIG. 9 is a longitudinal section through a modification of the third embodiment of this invention having a non-regenerative displacer linked to move with a piston;

FIG. 10 is a longitudinal vertical section through a fourth embodiment of this invention with a driven piston functioning as a heat pump or refrigeration device;

FIG. 11 is a longitudinal vertical section through a fifth embodiment of this invention with substantially circulatory flow through a cylinder and heated chamber;

FIG. 12 is a longitudinal section through a tube containing inserts providing somewhat unidirectional flow therethrough: and, FIG. 13 is a side view of a cam mechanism providing dwell periods at the ends of cam follower motion.

DESCRIPTION

As shown in FIG. 1, a heat engine 100 has a cylinder 102 having a cylinder head 104. The cylinder 102 is immersed in a cooling fluid 106 in cooling reservoir 108. A piston 110 in cylinder 104 is sealed with an internally pressurized annular rolling seal 112 having an inflation valve 114. A piston rod 116 fixed to piston head 111 extends to be pivotally connected to an intermediate portion 119 of a link 118. Link 118 has one end 120 pivotally connected to a fixed member 122 and its other end 124 pivotally connected to the connecting rod 126. Connecting rod 126 is rotatably secured to the crank 128 of crankshaft 129 which is rotatably mounted by a fixed member 132. Crankshaft 129 has flywheel 130 fixed on it. A heated chamber 140 extends from cylinder head 104 through cooling reservoir 108 and a flame guard 142. A working fluid 101 fills cylinder 102 and chamber 140. A heat source 144 under the heated chamber 140 may be an open flame gas burner or the like.

While an internally pressurized annular rolling seal 112 is shown on piston 110 inside cylinder 102, any equivalent piston and cylinder, bellows, or diaphragm device(not shown) may be used in the practice of this invention. The seal 112 will be described as its use led to the discovery and reduction to practice of the thermal lag engine 100. Although described in detail, seal 112 is not a required or needed element of this invention as other seal techniques may be substituted for it. The seal 112 is particularly effective to test conceptual heat engines, such as Stirling engines, using air as the working fluid operating at a mean atmospheric pressure.

Seal 112 may be a small vehicle inner tube stretched over piston 110, inserted in cylinder 102, and inflated through valve 114. As shown in FIG. 2 at top dead center, the seal 112 has rolled backward on piston 110 one half the distance piston 110 has advanced in cylinder 104. As shown in FIG. 3, at bottom dead center, the seal has rolled forward on piston 110 one half the distance the piston 100 has moved backward. Thus it may be seen that narrow inner and outer portions 103 and 105 are always in contact with piston 110 and cylinder 102 to provide an airtight seal 112 and allow valve 114 to project into piston 110 without leakage. Since seal 112 is of an elastomer, piston 110 and cylinder 102 may have very crude tolerances as the internal pressure in seal 112 will force it to conform to any irregularities.

Seal 112 allows piston 110 to move with very low friction. Seal 112 does not require a crosshead as it tolerates some rocking of piston 110 in cylinder 102 to accommodate the curvilinear motion of link 118.

On finding that a slight time delay in pressure change was observable when a displacer was rapidly moved in a Stirling engine displacer cylinder (not shown), it was felt that this time delay could be harnessed or put to use. For this reason, an experimental test engine, as shown in FIG. 1, was built. It had a cylinder 104 with a diameter of 9" and a piston 110 with a diameter of 7.5". Seal 112 was a 3.50/4.10×5 vehicle inner tube pressurized to 8 psig. Crank 128 and link 118 provided a piston stroke of 0.75". The pressure change in engine volume 101 on turning flywheel 130 was between +2.5 psig to −2.5 psig. Heated chamber 140 was a capped 40" length of nominal 1¼" pipe 100. Gas burner 144 was applied adjacent to flame guard 142 along chamber 140. The engine 100 showed no indications of running.

On turning out burner 144, connecting rod 126 was removed from link 124. The heated chamber 140 had not appreciably cooled and the piston 110 was fortunately near bottom dead center. With amazement, it was observed that link 118 vibrated and the vibration continued. On relighting burner 144, the engine 100 ran in this manner as a free piston engine for half an hour with a piston 110 stroke of about ¼" at about 200 cycles/minute.

The thermal lag engine 100 was operating, but only barely. It could not sustain a flywheel 130 even with a reduced stroke.

Links of chain(not shown) were placed in the heated chamber 140 and in the portion extending through the reservoir 108 to increase heat transfer. The 1¾" nominal pipe heated chamber 140 held about 11 chain links per inch of length and each link had a surface area of about 1 sq in. The chain increased heat transfer surface in chamber 140 from about 4 sg in/in of length to 15 sq in/in of length. This was merely an experimental expedient and not a suggested way to increase heat transfer area.

With the added chain(not shown) engine 100 then drove flywheel 130 at 450 rpm with a ¾" stroke of piston 110. This indicated that a thermal lag engine 100 could function and that further experimentation could lead to improved power and efficiency.

While it is inexpensive to experiment with mean atmospheric pressure engines 100 with annular rolling seals 112, these experiments indicate superior working fluids such as helium or hydrogen under a high pressure, such as 2000 psi, the types of seals used in modern Stirling engines, and other known techniques could provide powerful external combustion engines with high efficiencies. In Stirling engines other factors being the same, engine power varies almost directly with the mean engine pressure. The same should hold true for thermal lag engines to the extent that they are analogous to Stirling engines.

Since heated chamber 140 contains no working mechanisms, unlike the hot end or expansion end of a Stirling engine, a chamber 140 could be made with low dimensional tolerances of very high temperature tolerant materials such as tungsten, thoriated tungsten fibers in carbon, nobium carbide, zirconium carbide, or ceramic materials. This would allow very high Carnot efficiency heat engines to be built as a heated chamber 144 could have a temperature exceeding 2000 degrees C.

Referring now to FIGS. 8A–8D, a piston 210 fixed to piston rod 216 is in a cylinder 204. The volume swept by piston 210 is shown to be the same as the volume of heated chamber 240 to provide a compression ratio of 2:1. Cylinder 204 is disposed within a cooling reservoir 208. Heated chamber 240 has a heat source 244 beneath it. Heated working fluid 230 is indicated by dots and cooled working fluid 232 is unmarked. First to be considered will be discontinuous motion of piston 210.

In FIG. 8A, compression has just been completed by rapid motion of piston 210 to the right as shown to top dead center in cylinder 204. The working fluid 230 and 232 has been compressed to half its volume in the heated chamber 240 as shown. At the instant of compression, cooled working fluid 232 expelled from cylinder 204 has not had time to be heated in chamber 240.

As shown in FIG. 8B, after a time interval in which piston 210 does not move or moves very slightly, all the working fluid 230 in heated chamber 240 is heated.

As shown in FIG. 8C, after rapid movement of piston 210 to the left to bottom dead center as shown, heated working fluid 230 expands into the cylinder 204 so that, for an instant, all the working fluid 230 in the engine volume is heated.

As shown in FIG. 8D after a time delay at bottom dead center, working fluid 232 in cylinder 204 cools.

The cycle then repeats as piston 210 rapidly compresses air moving to bottom dead center as shown in FIG. 8A. As described, this thermal lag engine 100 is an external combustion Otto cycle device with adiabatic compression, constant volume heating, adiabatic expansion, and constant volume cooling.

Whether free piston or kinematically driven by a crank 128 as shown in FIG. 1, piston 110 or 210 will have a substantially sinusoidal motion. This provides a time lag near top and bottom dead center. As a crank 128 moves from 45 degrees before top dead center to 45 degrees past top dead center, the piston 110 will move through less that 15% of its stroke during 90 degrees of rotation of crank 128 and flywheel 130. The same holds for the 45 degrees before and after bottom dead center where piston 110 moves through less that 15% of its stroke while the crank rotates 90 degrees. During the 90 degree rotation of crank 128 between 45 degrees before and after top and bottom dead center, the piston 110 moves through over 70% of its stroke for rapid compression and expansion.

While sinusoidal piston 110 motion is the easiest to obtain, cams and other well known devices and mechanisms can provide a long piston delay at bottom and at dead center. As shown in FIG. 13, a cam 900 rotating with shaft 902 has a follower 904 mounted on cam rod 908 which is constrained to move vertically by guides 906. If a piston (not shown) was linked to rod 908, cam 900 would provide the piston with a pause or delay at top and bottom dead center.

In a thermal lag engine with a 2:1 compression ratio, only half the working fluid 230 or 232 as shown in FIGS. 8A and 8D, is heated or cooled. Thus half the engine volume of engine 100 of FIG. 1 is "dead space" in which the working fluid is not heated or cooled. This reduces efficiency by 50%. However, with high temperatures, the compression ratio could be increased to reduce dead space and increase efficiency. Additionally, there are adiabatic losses as cool air being compressed is heated by the compression and hot air expanding is cooled by its expansion. With high temperatures, adiabatic losses become less relevant as is the case with conventional internal combustion engines which may contain a momentary gas temperature of over 2000 degrees C. With sinusoidal motion of piston 110, there are further losses compared to the discontinuous motion of piston 210. The working fluid 230 and 232 may not be completely and uniformly heated and cooled. Even with these losses, using modern materials and techniques as developed for Stirling engines, an engine 100 may be built with an efficiency better than conventional Stirling or internal combustion engines. Not only is a thermal lag engine the ultimate in simplicity, but as an external combustion engine 100 it can use any fuel or heat source.

Referring now to FIG. 7, a piston 310 is in a cylinder 304 within a cooling reservoir 308. Heated chamber 340 is formed as a plurality of small diameter heated tubes 341 extending from cylinder 304 over heat source 344. If the plurality of smaller diameter heated tubes 341 provide the same engine volume as a single heated chamber 140 as shown in FIG. 1, the heat transfer area will be considerably increased. Heated chambers (not shown) with internal fins or other well known equivalent techniques to increase heat transfer area may be used with this invention. The term heated chamber is intended to include the plurality of tubes 341 and other equivalent configurations.

Referring now to FIG. 4, a heat engine 400 has a cylinder 404 in a cooling reservoir 408. Cylinder 404 contains a piston 410 and an internally pressurized rolling seal 412. A piston rod 416 fixed to piston 410 extends to link 418 and is connected thereto by a pin connection 424. Link 418 is pivotally mounted on a fixed member 422 having weights 460 and 462 mounted on its ends. A heated chamber 440 is disposed below cylinder 404 and reservoir 408. A passage 450 extends from cylinder 404 to a cooling chamber 452 immersed in reservoir 408.

Cooling chamber 452 provides additional heat transfer area to cool working fluid heated in heated chamber 440. A heat source 444 is disposed below heated chamber 440 which has insulation 446 above it. At least one tube 454 connects cooled chamber 452 and heated chamber 440. While cooled chamber 452 adds dead space to engine 400, it provides an expedient way to add cooling heat transfer area in an experimental engine. There are many well known methods to add heat transfer area to a piston 410 and cylinder 404, as, for example, by provided matching corrugations (not shown) to piston face 411 and cylinder head 405. When high technology thermal lag engines are built to operate at high pressures, heat transfer will increase with pressure and heat transfer surfaces and areas can be designed for optimum effect for given desired cyclic rates.

As is further shown in FIG. 4, two passages 454 and 456 extend between cooled chamber 452 and heated chamber 446. The passages 454 and 456 contain check valves 455 and 457. The check valves 455 and 457 ensure that flow from cooled chamber 452 enters one end 442 of heated chamber 440 and flow from heated chamber 440 leaves from the other end 441. This intermittent circulatory flow ensures that the last working fluid (not shown) entering the heated chamber 440 is the last to leave it. Thus the dwell time of working fluid in the heated chamber 440 is more uniform.

The check valves 455 and 457 should be very easily opened so as not to reduce or obstruct flow therethrough and take power from engine 400. They need only check the relatively small pressure developed by working fluid flow. For example, check valve 455 need only check pressure developed by flow from cooled chamber 452 through passage 456 and check valve 457 into heated chamber 440.

In a free piston thermal lag engine 400, such as that shown in FIG. 4, both the mass and the positioning of the weights 460 and 462 fixed on link 418 will tend to determine the frequency of operation of engine 400. Heavier weights 460 and 462 result in a slower running engine.

Referring now to FIG. 11, a piston 510 having a piston rod 516 is disposed in a cylinder 504 which is immersed in a cooling reservoir 508. A heated chamber 540 is disposed below a flame guard 542 and has a heat source 544 below it. A first passage 560 extends from one side of cylinder head 505 to one end 531 of the heated chamber 544. A passage 562 extends from the other side of cylinder head 505 to the other end 532 of heated chamber 544.

As shown in FIG. 12, passage 562 contains conical inserts 566 fixed therein, each insert 566 containing a central opening 567. As shown, flow is facilitated upward in passage 562 and retarded downward. With similar cones (not shown) facing downward in passage 560, flow is facilitated downward and retarded upward. Thus the cones 566 serve two purposes. They act to some extent as did the check valves 455 and 457 in FIG.

4 to provide a somewhat circulatory flow of working fluid with the resulting advantages as stated. The cones 566 provide increased heat transfer area and may also be installed in the heated chamber 544.

Referring now to FIG. 5, a thermal lag engine 600 has an inverted cylinder 604 containing a piston 610. A reservoir 608 containing cooling fluid 609 is disposed about cylinder 604. From cylinder head 611 a passage 654 extends to heated chamber 640 through the cooling fluid 609. Heat sources 644 are disposed below heated chamber 640. The upper wall 656 of chamber 640 has side walls 642 forming a reservoir containing a cooling fluid 648. A piston rod 616 is pivotally connected between piston 610 and link 618 which is pivotally mounted by a fixed member 622. One end 624 of link 618 is pivotally connected to connecting rod 626 which is rotatably fixed to crank 628 of crankshaft 629 which mounts flywheel 630. Crankshaft 629 is rotatably mounted by fixed member 632.

Within heated chamber 640 is a non-regenerative displacer 650 fixed to rod 652 which extends through passage 654 to be fixed to piston 610. The stroke of piston 610 is the same as the distance displacer 650 may move between the bottom hot wall 658 and the top cooled wall 656 of heated chamber 640.

Referring now to FIG. 6, a non-regenerative displacer 650 has a central metal plate 670 fixed to rod 652. Upper and lower layers of insulation 672 and 674 are fixed to metal plate 670. As piston 610 moves displacer 650 up and down in the heated chamber 640, working fluid must flow past displacer 650. It flows through the clearance 676 between the edge of displacer 650 and heated chamber 640. To prevent any substantial regeneration or heating and cooling of working fluid contacting displacer 650 during its flow past it, additional flow may be provided through vertical channels 676 in displacer 650. The essence of non-regeneration is to reduce the surface area of displacer 650 contacting air flowing past it. This is exactly opposite to the function of a displacer in a Stirling engine (not shown) where fine wires or screens provide a very large heat exchange area so that the regenerator captures heat from the hot working fluid flowing through it one way to give it up on flow through it the other way. The non-regenerative displacer 650 has its lower surface 675 heated by contact with bottom wall 658 and its upper surface 677 cooled by contact with top wall 656 of chamber 640.

Thermal lag engine 600 shown in FIG. 5 operates in the following manner. When piston 610 moves rapidly from bottom dead center to top dead center, cooled working fluid in the top of heated chamber 640 above the non-regenerative displacer 650 flowing through or around displacer 650 does not have time to become heated. With a time delay of piston 610 at top dead center and displacer 650 at an upper position, the working fluid below displacer 650 is heated by contact with bottom wall 658 of chamber 640 and the lower surface 675 of displacer 650.

On rapid downward motion of piston 610 from top dead center to bottom dead center, heated working fluid flowing above displacer 650 does not have time to cool. With a time delay at bottom dead center and displacer 650 at a lower position, heated working fluid above displacer 650 is cooled by contact with the upper surface 656 of chamber 640 and the upper surface 677 of displacer 650. Thus it may be seen that working fluid is cooler during compression and hotter during expansion to provide net work from shaft 629.

While engine 600 superficially appears to resemble a Stirling engine, thermal lag allows the power piston 610 and the non-regenerative displacer 650 to operate together or with a phase angle of 0 degrees. Thus the piston 610 and displacer 650 can be joined to move as a unit to avoid the complex linkages required in Stirling engines.

Referring now to FIG. 9, a thermal lag engine 700 has a piston 710 in a cylinder 704 sealed by a rolling seal 712. A heated chamber 740 has a heat source 744 disposed below it. The top wall 742 of chamber 740 has a lateral extension 746. Side walls 748 and 749 form a reservoir 750, partially over chamber 740, for cooling fluid 782. Cylinder 704 is mounted in reservoir 780 and has a passage 784 extending to chamber 740. A piston rod 716 fixed to piston 710 extends to be pivotally connected to link 718 which is pivotally mounted by a fixed member 722.

Crankshaft 729 is rotatably mounted by fixed member 732. Connecting rod 726 is rotatably fixed to the crank 728 of shaft 729. A flywheel 730 is fixed on shaft 729. The upper end 724 of connecting rod 726 is pivotally fixed to link 718. A non-regenerative displacer 750, similar to displacer 650 shown in FIG. 6, is disposed in chamber 740 and has an upward extending rod 752 fixed to it. A channel 754 extends upward from the top wall 742 of chamber 740 and slidably mounts rod 752 within it. An articulated link 770 connects rod 752 to link 718. Thus it may be seen that rotation of crank 728 moves the non-regenerative displacer 750 180 degrees out of phase with the power piston 710.

The placement of pivotal connection 772 of link 718 between the connections 774 and 776 can determine the relative distances of travel of piston 710 and displacer 750 to allow flexability of design of the chamber 740 and cylinder 704. Thermal lag engine 700 operates substantially as described for thermal lag engine 600. The advantages of these engines 600 and 700 over a Stirling engine is their greatly simplified linkages. It is to be noted that any regeneration by regenerator 650 or 750 would only serve to decrease efficiency in a thermal lag engine.

In general, if a heat engine is driven it can theoretically serve as a refrigeration device or a heat pump. Referring now to FIG. 10, a thermal lag machine 800 has a flywheel 830 driven by a motor 832 by means of belt 834. Flywheel 830 is fixed on crankshaft 829 which is rotatably mounted by a fixed member 838. A connecting rod 826 is journalled on crank 828 of shaft 829. The connecting rod 826 drives piston 810 in cylinder 804 disposed in a reservoir 808 containing a fluid 806. A chamber 840 extends from cylinder 804 into a reservoir 844 containing a fluid 846.

If thermal lag machine 800 is to function as a refrigerator or cooler, fluid 846 will serve as a heat sink at ambient temperature. On compression by downward motion of piston 810, working fluid in the machine volume will be heated adiabatically by compression. On piston 810 dwelling at bottom dead center, the adiabatically heated working fluid in chamber 840 will cool losing heat to fluid 846. On upward motion of piston 810, working fluid entering cylinder 804 will be adiabatically cooled by its expansion. On piston 810 dwelling at top dead center, the cooled working fluid in cylinder 804 will be warmed by fluid 806 which will thereby be cooled. The cooled fluid 806 can be used for refrigeration purposes. Compression ratios higher than 2:1 may be desirable.

In a like manner, if fluid 806 in reservoir 808 is maintained at ambient temperature, fluid 846 in reservoir 844 will be warmed so that the thermal lag machine 800 may serve as a heat pump.

In piston and cylinder combinations, such as piston 110 and cylinder 102, only the cylinder 102 is shown cooled. While a piston 110 is somewhat cooled by a cylinder 102, well known cooling techniques can be used with pistons 110. Seals 112 can be pressurized by a cooling fluid.

What is claimed is:

1. A heat engine operating by means of thermal lag comprising, in combination, a cooled variable volume device, a heated chamber connected to said variable volume device, and a working fluid in said variable volume device and said chamber, said variable volume device causing at least partial adiabatic compression and expansion of said working fluid, said variable volume device and said chamber having heat transfer surfaces, at least some of said heat transfer surfaces in said chamber being disposed close to said variable volume device, said variable volume device having at least a reduced rate of volume variation at the end of compression and expansion so that heat transfer from said working fluid to and from said heat transfer surfaces takes place during said reduced rate of volume variation.

2. The combination according to claim 1 wherein said variable volume device is a cylinder and a piston, said piston reciprocating within said cylinder with substantially sinusoidal motion.

3. The combination according to claim 2 with the addition of a rotatably mounted crankshaft having a crank, and a connecting rod linked to said piston and rotatably connected to said crank.

4. The combination according to claim 2 wherein said piston reciprocates as a free piston.

5. The combination according to claim 1 wherein the reduced rate of volume variation at the end of compression and expansion includes a pause in volume variation.

6. A thermal lag heat engine comprising, in combination, a cylinder, a piston within said cylinder, cooling means associated with said piston and cylinder, a heated chamber closely connected to said cylinder, a working fluid in said cylinder and said heated chamber, said cylinder, said piston, and said chamber having surfaces to transfer heat to said working fluid, driven means linked to said piston reciprocating said piston in said cylinder between top and bottom dead center so that said piston causes compression and expansion of said working fluid in said cylinder and said chamber, said driven means reciprocating said piston at least at a reduced rate approaching and leaving top and bottom dead center so that said working fluid from said cylinder entering said heated chamber during compression does not have time to become substantially heated, said working fluid in said heated chamber becoming increasing heated as said piston at a reduced rate approaches and leaves top dead center, said working fluid entering said cylinder during expansion does not have time to become substantially cooled, and said working fluid in said cylinder becoming increasing cooled as said piston at a reduced rate approaches and leaves bottom dead center, said working fluid being cooler during compression and hotter during expansion so that said piston drives said driven means.

7. The combination according to claim 6 wherein said driven means provides a substantially sinusoidal motion to said piston.

8. The combination according to claim 7 wherein said driven means allows free piston motion of said piston.

9. The combination according to claim 7 wherein said driven means is a crank and a connecting rod, said connecting rod journalled on said crank and linked to said piston.

10. The combination according to claim 6 wherein said heated chamber has a heated wall and a cooled wall, and with the addition of a substantially non-regenerative displacer in said heated chamber, and means linking said non-regenerative displacer to move with said piston between said heated and cooled walls.

11. The combination according to claim 6 with the addition of a cooled chamber disposed between said heated chamber and said cylinder.

12. The combination according to claim 6 with the addition of two spaced apart passages entering said heated chamber, and two flow directing devices associated with said passages directing flow into said heated chamber from one of said passages and out of said heated chamber into the other of said passages.

13. The combination according to claim 12 wherein said flow directing devices are check valves.

14. The combination according to claim 13 wherein said flow directing devices are inserts in said passages retarding flow in one direction more than in the other.

15. The combination according to claim 12 wherein said passages extend from spaced apart portions of said cylinder.

16. The combination according to claim 2 with the addition of a cooled volume between said cylinder and said heated volume, a third passage from said cylinder to said cooled volume, said two spaced apart passages extending between said heated volume and said cooled chamber.

17. The combination according to claim 6 wherein said heated chamber comprises a plurality of smaller diameter tubes.

* * * * *